US010060633B2

(12) United States Patent
Mallet et al.

(10) Patent No.: US 10,060,633 B2
(45) Date of Patent: Aug. 28, 2018

(54) COOKING HOB WITH WINDOW, COOKING APPLIANCE, AND PROCESS FOR MANUFACTURING THE HOB

(75) Inventors: Claire Mallet, Outremont (CA); Adele Verrat-Debailleul, Villers-sur-Coudun (FR); Beatrice Mottelet, Compiegne (FR); Franck Demol, Chateau-Thierry (FR); Gerard Huchet, Autreches (FR)

(73) Assignee: EUROKERA S.N.C., Chateau-Thierry (FR)

( * ) Notice: Subject to any disclaimer, the term of this patent is extended or adjusted under 35 U.S.C. 154(b) by 776 days.

(21) Appl. No.: 14/346,200

(22) PCT Filed: Sep. 14, 2012

(86) PCT No.: PCT/FR2012/052061
§ 371 (c)(1),
(2), (4) Date: Mar. 20, 2014

(87) PCT Pub. No.: WO2013/079833
PCT Pub. Date: Jun. 6, 2013

(65) Prior Publication Data

US 2014/0216435 A1 Aug. 7, 2014

(30) Foreign Application Priority Data

Sep. 26, 2011 (FR) ..... 11 58537

(51) Int. Cl.
*F24C 15/10* (2006.01)
*F24C 7/08* (2006.01)

(52) U.S. Cl.
CPC ..... *F24C 15/10* (2013.01); *F24C 7/083* (2013.01)

(58) Field of Classification Search
CPC ..... F24C 15/10; F24C 7/083
See application file for complete search history.

(56) References Cited

U.S. PATENT DOCUMENTS 3,838,505 A * 10/1974 Doner ..... H05B 3/74 219/452.12
4,492,217 A * 1/1985 Scheidler ..... F24C 15/108 126/148

(Continued)

FOREIGN PATENT DOCUMENTS

DE 196 12 621 10/1997
DE 19835140 A1 * 2/2000 ..... F24C 15/108

(Continued)

OTHER PUBLICATIONS

U.S. Appl. No. 14/647,370, filed May 26, 2015, Verrat-Debailleul, et al.

(Continued)

*Primary Examiner* — Kenneth Rinehart
*Assistant Examiner* — Logan Jones
(74) *Attorney, Agent, or Firm* — Oblon, McClelland, Maier & Neustadt, L.L.P.

(57) ABSTRACT

A cooking hob, or a ceramic hob, for a fixed or mobile cooking appliance, the hob including at least one cooking area and at least one control and/or information area, the control and/or information area being formed by a window separated from the cooking area by at least one joint made of synthetic material. The joint includes a mechanism for fixing a control and/or display screen under the window.

9 Claims, 4 Drawing Sheets

(56) References Cited

U.S. PATENT DOCUMENTS 4,960,978 A * 10/1990 Lorenz ..... H05B 3/72 219/448.17
5,317,129 A * 5/1994 Taplan ..... F24C 15/102 126/211
5,357,079 A * 10/1994 Henry ..... H05B 3/746 126/211
5,357,080 A * 10/1994 Vetter ..... F24C 7/083 116/279
5,442,470 A * 8/1995 Hashimoto ..... G02F 1/133308 349/149
5,528,015 A * 6/1996 von Blanquet ..... F24C 7/082 219/445.1
5,584,957 A * 12/1996 Schultheis ..... B29C 65/76 126/211
5,717,189 A * 2/1998 Goetz ..... H05B 3/74 219/445.1
5,844,206 A * 12/1998 Steiner ..... A47B 77/08 219/452.12
5,958,272 A * 9/1999 Taplan ..... G01G 19/56 219/445.1
6,398,903 B1 * 6/2002 Stedron ..... B22D 19/0045 156/289
7,120,010 B2 * 10/2006 Tajima ..... G02F 1/133308 248/917
2003/0117053 A1 * 6/2003 Tajima ..... G02F 1/133308 313/292
2003/0183617 A1 * 10/2003 Platt ..... F24C 7/083 219/452.11
2004/0031230 A1 * 2/2004 Pabedinskas ..... E04C 3/28 52/839
2012/0138042 A1 * 6/2012 Huntscha ..... F24C 7/083 126/211

FOREIGN PATENT DOCUMENTS

DE 10 2007 021939 11/2008
EP 0 570 670 11/1993
EP 2 290 292 3/2011
GB 2100853 A * 1/1983 ..... F24C 15/102

OTHER PUBLICATIONS

U.S. Appl. No. 14/647,308, filed May 26, 2015, Verrat-Debailleul, et al.
International Search Report dated Dec. 13, 2012 in PCT/FR12/52061 filed Sep. 14, 2012.

* cited by examiner

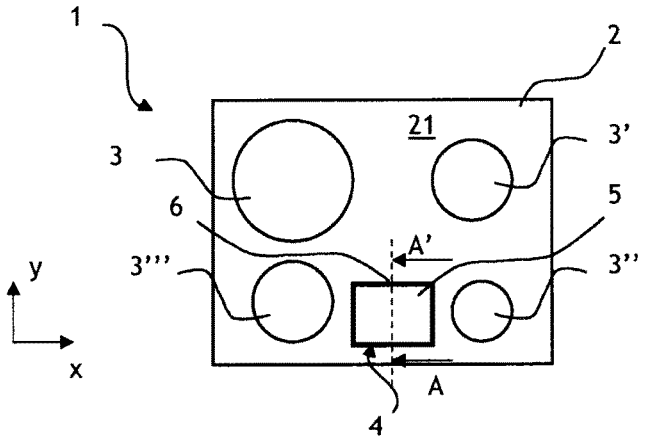
fig. 1
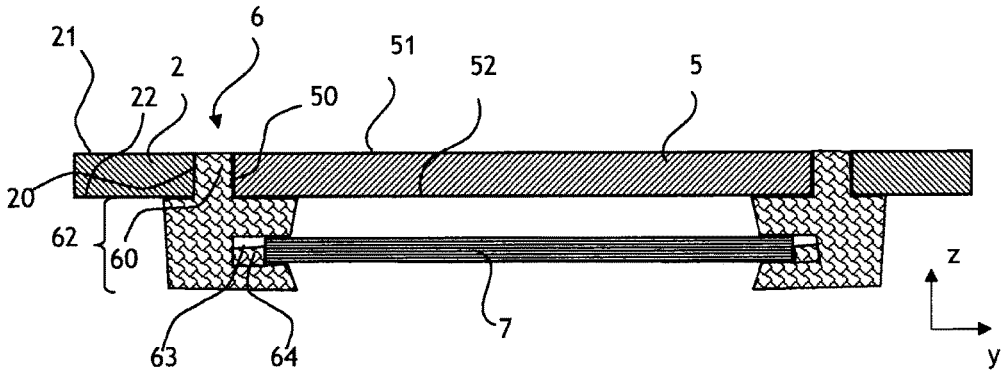
fig. 2 (A-A')
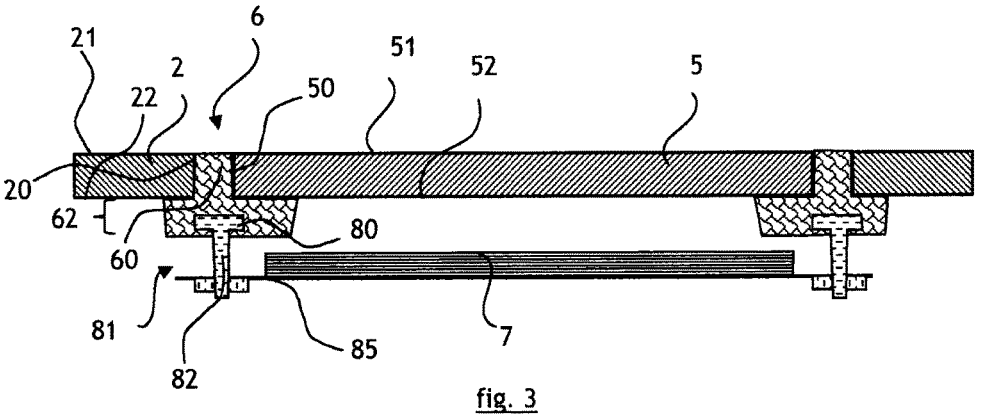
fig. 3

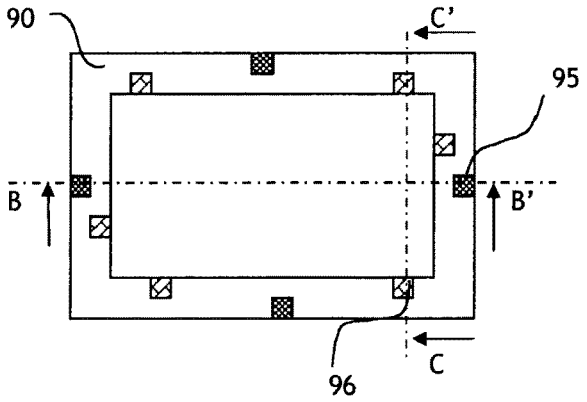
fig. 9
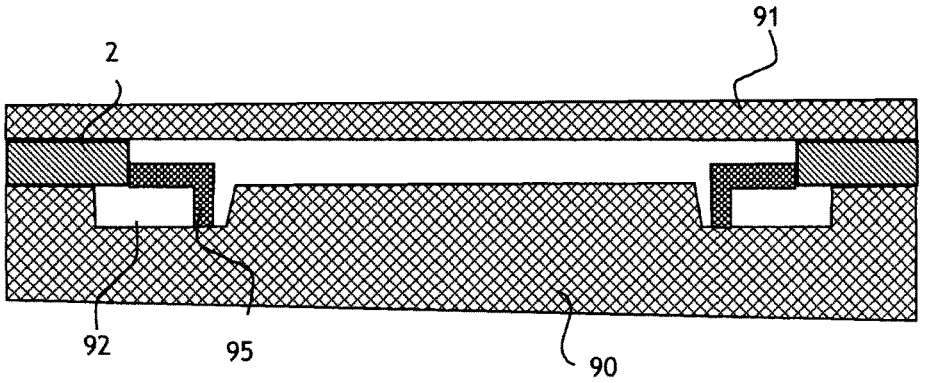
fig. 10 (B-B')
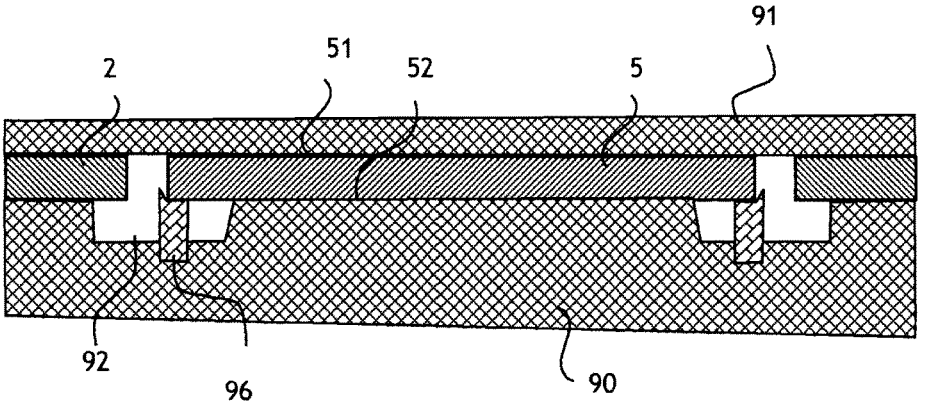
fig. 11 (C-C')

COOKING HOB WITH WINDOW, COOKING APPLIANCE, AND PROCESS FOR MANUFACTURING THE HOB

CROSS-REFERENCE TO RELATED APPLICATIONS

The present application is the U.S. counterpart of WO 2013/079833, and claims priority to French application no. 1158537 filed Sep. 26, 2011, the entire contents of each of which are incorporated by reference.

BACKGROUND

The present invention relates to a cooking appliance with a cooking hob and notably to a fixed cooking appliance intended to be incorporated into a rack placed in a work surface or in a cooker or a mobile cooking appliance which is able to be moved manually and easily.

A cooking appliance with a cooking hob includes a cooking hob, for example a ceramic hob, on which it is possible to place a saucepan, a frying pan or any other utensil likely to contain foodstuffs to be re-heated or cooked, even on which foodstuffs to be re-heated or cooked can be placed directly.

Furthermore, said cooking appliance generally has a casing including a bottom and side walls forming a base inside of which is (or are) positioned one (or several) heating element(s), such as, for example, radiant or halogen hob plates, as well as means of control so as to vary the power thereof, even to program when they start and when they stop. The cooking hob closes the top of the casing.

The present invention relates more particularly to a cooking hob for a fixed or mobile cooking appliance including, on the one hand, a base hob, notably a ceramic base hob, having at least one cooking area and including, on the other hand, at least one control and/or information area, said control and/or information area being formed by a window separated from said base hob by at least one joint made of synthetic material.

Realizing a joint between a window, under which is positioned a screen, and the base hob is known notably from French patent application No FR 2 746 904. The invention which is the object of said document is based on the selection of the material of the joint in order to enable tightness between the window and the base hob.

In FIG. 3 said document shows a screen which "floats in space"; there is no description of any means for fixing the screen. It is supposed that the screen is fixed to the casing, but there is no information in this regard.

A first disadvantage of said configuration is that it is difficult to realize precise positioning and precise fixing of the screen, in the three spatial dimensions, in relation to the window which is situated below it; now this positioning is very important in order to ensure a perception of quality of the display of the screen through the window.

Said disadvantage is reinforced by the fact that the connection between the window and the base hob is a connection with permanent elasticity as claimed in the document. Said connection, however, is not rigid and the window can thus move with use. Said movement is harmful to the perception of the screen display through the window.

Said problem of good perception of the screen display through the window is all the more important as it is now possible to realize small-sized screens with very high levels of resolution; however, if the last element inserted between the screen and the observer is not well designed, then the final resolution will be seriously affected.

BRIEF SUMMARY

The object of the invention is to alleviate the disadvantages of the prior art and to supply a solution that is simple to implement and is not expensive in order to ensure reliable, precise positioning and reliable, precise fixing of a display screen in relation to a window placed in a cooking hob and through which what is on said screen is displayed.

The present invention thus relates in its widest sense to a cooking hob for a fixed or mobile cooking appliance including a base hob, notably a ceramic base hob, having at least one cooking area and including at least one control and/or information area, said control and/or information area being formed by a window separated from said base hob by at least one joint made of synthetic material, notable in that said joint includes means for fixing a control and/or display screen under said window.

The present invention thus proposes to use the joint, which is provided at least in part around the window, between the window and the base hob, in a direct manner in order to position and fix the control and/or display screen in relation to said window in an ideal manner.

The window which is thus situated above the control and/or display screen is transparent so as to make it possible to see what is displayed on the screen; it is made of a material that is different to that of the base hob; the screen is of LCD, LED or OLED type and is perhaps a touch screen.

The fixing of the screen to the joint is preferably mechanical fixing and is thus not chemical fixing (notably bonding).

The joint thus has, preferably, a central part which is situated both opposite at least part of the edge of the window and opposite part of the perimeter of the hole which is placed in the base hob and which accommodates the window.

As claimed in an important characteristic of the invention, said joint preferably has a joint inner part extending under an inner surface of said base hob and/or under an inner surface of said window. Said inner part thus allows the mechanical hold of the connection between the joint and respectively said base hob and/or said window to be increased.

Under the inner surface of the window, said joint inner part, in vertical section, can be in the shape, for example, of a C or an L.

As claimed in the variants of the invention, the cooking hob can include:

- at least one insert which is completely incorporated into said joint,
- on the one hand, a base which is incorporated at least in part, even completely, in a portion of the material of said joint and, on the other hand, at least one protruding element which protrudes at least in part, even completely, outside of said joint, for fixing said control and/or display screen;
- at least one screw and/or one support and/or one clip and/or one rail, for fixing the control and/or display screen to said joint.

It is possible, moreover, that part at least of an outer surface of said window (where the window is inclined in relation to the base hob), that even an entire outer surface of said window (where the window protrudes or is below in relation to the base hob) is not in the plane of an outer surface of said base hob.

Preferably, said joint has a joint outer part extending above a joint central part and possibly extending over an outer surface of said base hob and/or over an outer surface of said window.

The present invention also relates to a fixed or mobile cooking appliance provided with a cooking hob as claimed in the invention.

The present invention also relates to several methods of manufacturing the cooking hob as claimed in the invention.

In a first process of manufacturing the cooking hob as claimed in the invention, said base hob and said window are arranged in a mold which is then closed and a synthetic material is then injected into a mold cavity so as to form said joint including means for fixing the control and/or display screen.

In a second process of manufacturing the cooking hob as claimed in the invention, a joint that has been preformed and includes means for fixing the control and/or display screen is bonded to said base hob and/or to said window.

In a third process of manufacturing the cooking hob as claimed in the invention, said joint including means for fixing the control and/or display screen is molded against said base hob or against said window, said window or respectively said base hob then being introduced into a groove of a frame formed by the joint when said joint is hot.

In an advantageous manner, the present invention allows, in a simple, efficient manner, a control and/or display screen to be positioned with precision in the three spatial dimensions in a cooking hob in relation to a window situated above said screen and to be fixed with precision in the three spatial dimensions. The positioning precision and the fixing precision can be achieved for example to a tenth of a millimeter.

Equally in an advantageous manner, the joint as claimed in the invention allows the edge of the window to be protected, even if said window does not follow the continuity of the surface of the hob (protruding in relation to the outer surface of the hob but parallel to the hob) or if said window is inclined in relation to the hob.

Equally advantageously, the joint as claimed in the invention allows the fluid-tightness to be ensured between the edge of the window and the perimeter of the hole realized in the hob, even if said window does not follow the continuity of the surface of the hob (protruding in relation to the outer surface of the hob but parallel to the hob) or if said window is inclined in relation to the hob.

Equally advantageously, the solution of the invention is applicable even when the control and/or information area is situated on the edge of the cooking hob.

Advantageously furthermore, the fact that the control and/or display screen is fixed to the joint allows the screen to be changed easily if necessary (if the screen is faulty): all that is necessary is to access under the cooking hob and to undo the means for fixing the screen; furthermore, it is easy and not expensive to proceed with changing the faulty screen for a screen that operates correctly and which will, in turn, be positioned with precision and fixed with precision in relation to the window; it is not necessary to change the base hob, nor the window, nor to remake the joint between the base hob and the window.

BRIEF DESCRIPTION OF THE DRAWINGS

The present invention will be better understood by reading the detailed description below of non-restricting exemplary embodiments and the accompanying figures:

FIG. 1 shows a schematic top view of a cooking hob as claimed in the invention with a base hob including a full hole and a window in said hole;

FIG. 2 shows a partial vertical cutaway view according to AA' in FIG. 1;

FIGS. 3 to 6 show respectively a section equivalent to that of FIG. 1 for other variants of embodiments of the invention;

FIGS. 9 to 11 show respectively a top view of part of a mold of FIG. 8 and a partial vertical cutaway view according to B-B' and according to C-C' of FIG. 9.

DETAILED DESCRIPTION

Figure 4:
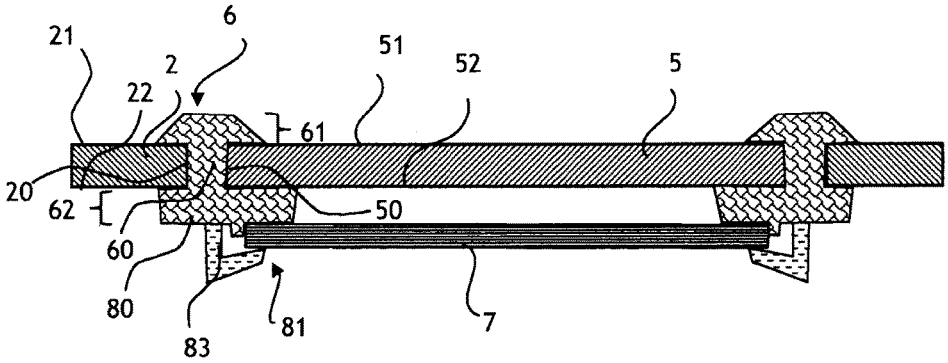

It is made clear that the proportions between the various elements shown are not strictly respected in said figures and the elements in the rear plane are not all shown so as to simplify the reading of the same.

FIG. 1 shows an exemplary embodiment of a cooking appliance as claimed in the invention. The appliance shown here thus has a general straight, parallelepipedic shape.

The appliance shown here is a fixed cooking appliance, also called an "integrated appliance", which is intended to be installed in a rack placed in a work surface or in a cooker and which, once it has been installed and fixed, can no longer be moved; however, the present invention is also applicable to a mobile cooking appliance, being in the form of a casing and which can be positioned, for example, on a work surface or on a dining table and which can be moved manually.

The cooking appliance includes a cooking hob 1 which is flat and which has a general straight, parallelepipedic shape (that is to say rectangular or square when seen from above).

Said cooking hob 1 includes a base hob 2 which, in particular, can be a ceramic hob.

Even if, when seen from above, the most popular shape for the base hob is a rectangle, the base hob, when seen from above, can also have a circular shape, or a kidney shape or even a trapezoidal shape; the only constraint to the shape is that connected with the method of manufacturing the base hob.

The base hob 2 includes a flat outer surface 21 intended to be positioned horizontally and on which the cooking utensils (saucepans or others) sit to be heated. In the remaining description, the cooking hob 1 as claimed in the invention is considered as being positioned horizontally and the positionings: under/underneath and on/above are realized in relation to the vertical.

Even if a base hob is flat in general, it is possible for a base hob to be curved inward, notably toward the inside of the cooking appliance.

The base hob 2 here has four cooking areas 3, 3', 3", 3'", shown here by circles with different diameters, but which can be in any shape.

Furthermore, the cooking hob 1 includes a control and/or information area 4.

A heating element (not shown) such as a radiant or halogen element and/or at least one gas burner and/or at least one induction heating coil is positioned under each cooking area of the base hob 2. Moreover, equally for simplification, the supply of the heating element has not been shown.

The control and/or information area 4 is the place from where it is possible to control the operation of each cooking area 3, 3', 3", 3'" and/or where it is possible to display information relating to the operation of each cooking area 3, 3', 3", 3'".

In this case, the sole control and/or information area 4 is the place from where it is possible to control the operation of all the cooking areas 3, 3', 3", 3'" independently and where it is possible to display information relating to the operation of all the cooking areas 3, 3', 3", 3'" independently; however, there could be, for example, two control and/or information areas, with for each control and/or information area the possibility of controlling the operation of two of the four cooking areas independently and the possibility of displaying information relating to the operation of said two cooking areas independently.

It is possible, furthermore, for the (or each) control and/or information area to allow another appliance or other appliances to be controlled and/or information relating to another appliance or other appliances to be displayed, or even to display any type of information.

The control and/or information area 4 is formed by a window 5 which is in a material that is different to that of the base hob 2.

In particular, when the base hob 2 is ceramic, its constituent material prevents a clear, precise transmission of information through it.

By way of example, the base hob made of Kerablack black ceramic marketed by Eurokera has a luminous transmission in the visible in the region of 1.5% (integrated value, measured according to illuminant D65) and blurriness in the visible in excess of 95%.

Furthermore, there are black ceramic base hobs that are more transparent and more expensive, the integrated luminous transmission of which is higher but remains weak (less than 5%), and the polychromatic transmission (for white) remains unsatisfactory.

The window 5 is preferably made of glass, possibly dip-coated thermally or chemically or possibly hardened. It is transparent, with an integrated luminous transmission in the visible in excess of 70% (measured for example according to illuminant D65); it is clear and has less than 50% blurriness.

It is possible to provide a transparent polymer film under a sheet of glass in order to form a window 5 that is particularly tough.

The window 5 is separated, with no direct physical contact, from the base hob 2 by a joint 6 made of non-mineral, synthetic material.

In this case, the window 5, when seen from above, is in the shape of a rectangle and is positioned in a hole that is of a similar shape but is a little bit wider and a little bit longer than the window and which has been placed beforehand in the base hob 2. Said hole is a throughhole in the sense that it opens into the outer surface 21 of the base hob 2, as well as into an opposite surface: the inner surface 22 of the base hob 2 (not visible in FIG. 1); said parallelepipedic hole is a full hole in the sense that its entire outer periphery is realized on the outer surface 21 and its entire inner periphery is realized on the inner surface 22.

Even if the most popular shape for the window is the shape of a rectangle when seen from above, the window, when seen from above, can also have a circular shape, or a kidney shape or even a trapezoidal shape; the only constraint to the shape is that connected with the method of manufacturing the window.

As claimed in the invention, said joint 6 includes means for fixing, directly or indirectly, a control and/or display screen 7 under the window 5 to the joint 6 in the three spatial dimensions x, y, z, in such a manner that the orientation of said screen in relation to the window 5 is unchanged as soon as the screen is fixed rigidly to said window and it is therefore possible to display what is on the screen 7 through the window 5.

The screen 7 is thus correctly parallel to the window 5 and the display of what is on the screen is ideal. There is no distortion whatsoever of the image through the window 5.

The window is preferably attached along its edge to the base hob 2 only by the joint 6.

The joint 6 is thus present over the entire periphery of the window 5, or in any event along the periphery of the window 5 which is opposite the base hob 2.

The joint 6 thus has a central part 60 which is situated both opposite at least part of the edge 50 of the window 5 and opposite part of the perimeter 20 of the hole which is placed in the base hob 2 and which accommodates the window 5.

As explained below, said central part 60 can be situated opposite at least part of the edge of the window 5 over the length and/or the height of said edge 50 and said joint central part 60 can be situated opposite at least part of the perimeter 20 of the hole over the length and/or the height of said hole.

As claimed in an important characteristic of the invention, said joint 6 preferably has a joint inner part 62 extending under the inner surface 22 of the hob 2 and/or under the inner surface 52 of the window 5.

The joint 6 has a joint inner part 62 which preferably extends both under the inner surface 22 of the hob 2 and under the inner surface 52 of the window 5, as shown by way of FIGS. 2 to 6, so as to improve the mechanical hold between the window 5 and the base hob 2 by means of the joint 6.

In a first embodiment variant of the invention, it is the joint 6 itself which enables the screen 7 to be attached directly; to do this, the joint inner part 62, under the inner surface 52 of the window 5, in vertical section is:

- either in the shape of a C, so as to be able to accommodate part of the control and/or display screen 7 in a groove 63 created between the wings of the C, as shown in FIG. 2,
- or in the shape of an L, so as to be able to rest the screen 7 on the base of the L, between said base and the inner surface 52 of the window 5.

In said two configurations, it is possible for the joint inner part 62 to extend under the inner surface 22 of the hob 2.

In said two configurations, the C or L shape is sufficiently lengthened in order to enable a rail to be formed to accommodate two sides of the screen 7.

With said configurations, it is thus possible to make the screen 7 slide in the x direction in order to position it correctly under the window 5. Blocking in the y direction is ensured by at least one stop 64 which is present in each groove 63. Blocking in the z direction is ensured by the fact that the height of the groove 63 is appreciably the same as the thickness of the screen 7, or at least the same as the thickness of the part of the screen 7 that has to slide toward the inside.

With reference to FIG. 1, the screen can thus be slid under the window 5 in the groove 63 from the right or from the left; it is also possible to provide that a left or right edge of the joint 6 is also provided with the joint inner part 62 in the shape of an L or a C so that the screen is held on three sides once it has been correctly positioned under the window 5.

In order to increase the mechanical hold of the joint 6, it is possible to provide that it includes an insert which is completely incorporated into the material of the joint. Said insert is preferably metallic, with a coefficient of expansion which is preferably relatively weak and which is adjusted to the thermal constraints of the manufacture of the joint 6 and to the thermal constraints of the operation of the cooking appliance.

The insert can be perforated so that the material of the joint penetrates the perforations and thus increases the mechanical cohesion between the insert and the joint.

The insert can be positioned at least in part in the joint central part 60 and/or in the joint outer part 61 and/or in the joint inner part 62.

As an alternative to the first variant of the embodiment of the invention, it is not the joint 6 itself which enables the screen 7 to be directly attached, but an accessory attached to the joint 6 which enables the screen 7 to be indirectly attached to the joint 6.

Said accessory can be an insert as indicated previously, for example, but including, on the one hand, a base 80 which is incorporated at least partially, even completely, in a portion of the material of the joint 6 and, on the other hand, at least one protruding element 81 which protrudes at least in part, even completely, outside of said joint 6, for fixing said control and/or display screen 7. The protruding element 81 extends approximately perpendicularly with respect to the general plane of the base 80.

The base 80 can be provided along the two left and right edges of the window 5 (with reference to the positioning of FIG. 1). It allows its mechanical connection between the joint 6 and the screen 7 to be strengthened.

Figure 5:
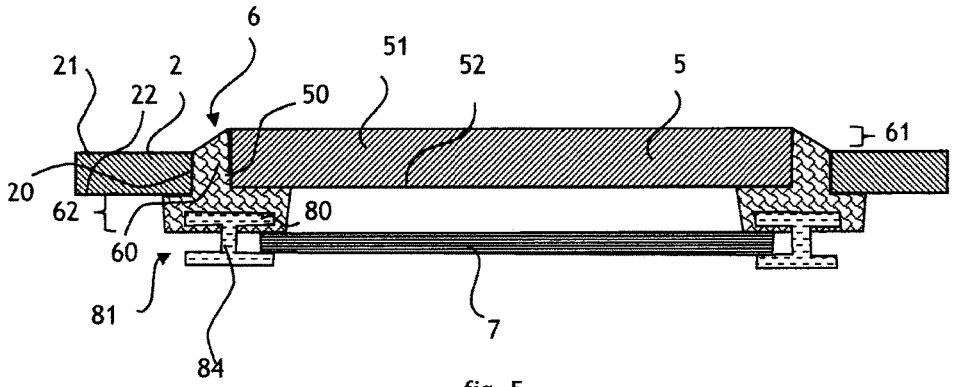

The protruding element 81 can have different shapes:

- in FIG. 3, the protruding element is a screw 82, soldered to the base 8 at its high end and provided with a thread in its low part in order to enable a nut to be screwed on; two screws are preferably provided at least along each of the two left and right edges of the window 5 so as to enable a support 85 to be retained, fitted on the screws 82 and on which the screen 7 is fixed and thus to enable the screen to be fixed indirectly to the joint 6 in the three spatial dimensions;
- in FIG. 4, the protruding element is a support 83 (or clip) curved in the shape of an L; two supports 83 are preferably provided along each of the two left and right edges of the window 5 so as to enable the screen 7 to be positioned and fixed correctly under the window 5; for a better hold, it is possible to provide that the screen is sandwiched by each left and right side, between the support 83 and the joint inner part 62; said support 83 can be manufactured for example by bending;
- in FIG. 5, the insert is a rail 84 in the shape of an H; a rail 84 is preferably provided along each of the two left and right edges of the window 5 so as to allow the screen 7 to slide on the rails in order to position it correctly under the window 5; for a better hold, it is possible to provide that the screen is sandwiched by each left and right side, between the protruding part of the rail 84 and the joint inner part 62; said rail can be produced for example by extrusion.

As a variant, the protruding element could be a clip in the manner of clips known for fixing windscreens in the frame of a vehicle body.

It is possible, moreover, to provide that a nut is attached (for example soldered) to a protruding part of an insert.

As can be seen in FIGS. 2 and 3, it is possible to provide that the window 5 has the same thickness as the base hob 2 and that the outer surface 51 of the window 5 follows precisely the continuity of the outer surface 21 of the base hob 2.

However, it is also possible for the window 5 to be less thick than the hob 2 and for the joint 6 thus to enable said difference in thickness to be compensated in order to ensure that the outer surface 51 of the window 5 follows exactly the continuity of the outer surface 21 of the base hob 2; in this case, the inner surface 52 of the window 5 does not come up to the inner surface 22 of the base hob 2, upwardly.

In said two FIGS. 2 and 3, the joint central part 60 enables a surface continuity to be realized between the outer surface 51 of the window 5 and the outer surface 21 of the base hob 2 by very precisely filling in the space available between said two surfaces in a fluid-tight manner.

In FIG. 4, the window 5 has the same thickness as the base hob 2, but a joint outer part 61 extends above the joint central part 60. In said figure, the joint outer part 61 extends over the outer surface 21 of the base hob 2 and over the outer surface 51 of the window 5; however, it is possible to provide that the joint outer part 61 extends very precisely just above the joint central part 60, following the vertical continuity of the joint central part 60 without overflowing onto the outer surface 21 of the base hob 2 and/or onto the outer surface 51 of the window 5.

The ends jutting out toward the outside of the joint outer part 61 are preferably not at a right angle, that is to say at a cut angle or at a rounded angle.

In FIG. 5, the outer surface 51 of the window 5 juts out from the outer surface 21 of the base hob 2 upwardly; the outer surface 51 of the window 5 is thus raised in relation to the outer surface 21 of the base hob 2.

This can be obtained for example by providing:

- that the inner surface 52 of the window 5 follows precisely the continuity of the inner surface 22 of the base hob 2 but that the window 5 is thicker than the base hob 2; or
- that the window 5 has appreciably the same thickness as the base hob 2 and that the inner surface 52 of the window 5 also does not come up to the inner surface 22 of the base hob 2, upwardly.

Said FIG. 5 shows the fact that the joint central part 60 provides its join along the entire periphery of the window 5 between the outer surface 21 of the base hob 2 and the outer surface 51 jutting out from the window 5, so as to protect the edge 50 of the window 5.

As a variant, it is possible to provide that certain peripheral edges, even all the peripheral edges, of the outer surface 51 of the window 5 are beveled (not a right angle).

It is possible to provide that the window 5 enables a magnifying effect in relation to the screen 7 for any observer looking at the screen 7 from above the window 5, either by means of a sheet of glass having a particular focal distance, or by means of a transparent polymer film bonded against the inner surface 52.

Figure 6:
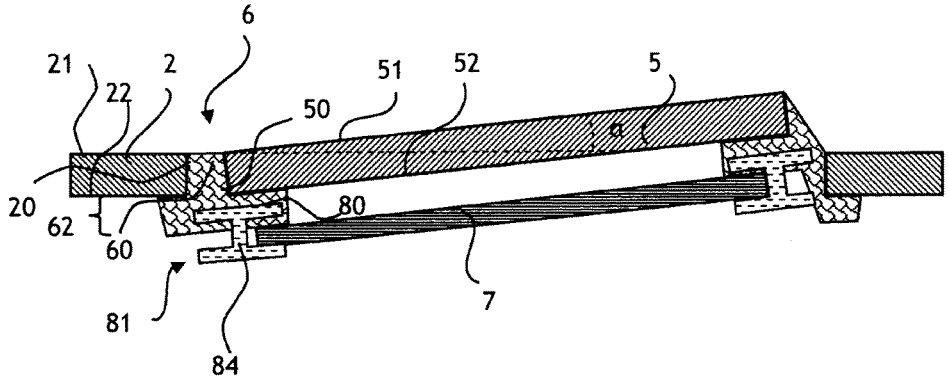

In FIG. 6, unlike all the previous variants, the window 5 is not positioned parallel to the base hob 2, but is inclined in relation to said hob, by an angle $\alpha$ of between 2° and 45° inclusive, even of between 5° and 25° inclusive.

Said FIG. 6 also shows the fact that the joint central part 60 provides the tight join over the entire periphery of the window 5 between the outer surface 21 of the base hob 2 and the outer surface 51 jutting out from the window 5, so as to protect the edge 50 of the window 5.

Figure 7:
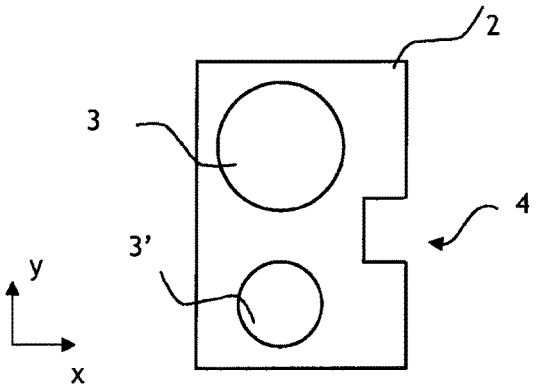
FIG. 7 shows a schematic view of another base hob as claimed in the invention with a notch for accommodating a window.
Figure 8:
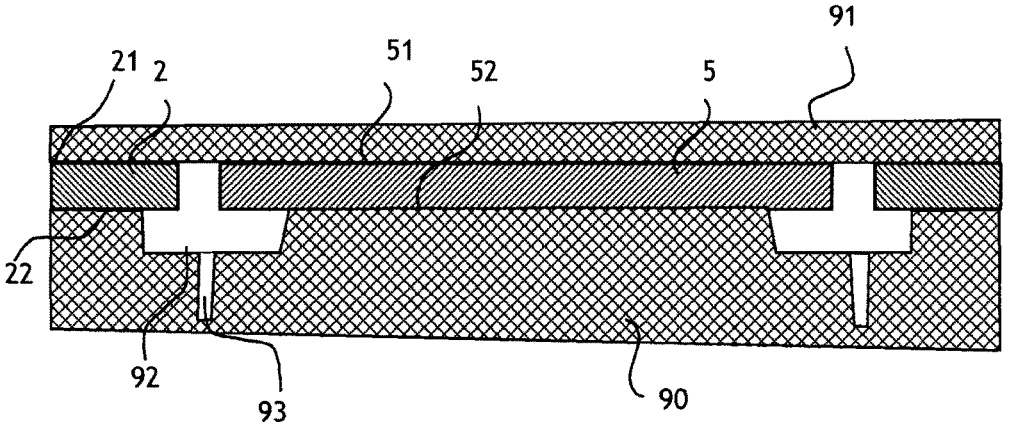
FIG. 8 shows a cutaway view of an exemplary embodiment of a mold for realizing the joint as claimed in one embodiment of the joint according to FIG. 3.

FIG. 7 shows another base hob 2: unlike the base hob of FIG. 1, only two cooking areas 3, 3' are provided.

Furthermore, unlike the base hob of FIG. 1, the hole which accommodates the control and/or information area 4 is not a full hole, but a partial hole, along one of the edges of the base hob 2 (in this case the right-hand edge).

Thus, said hole is a throughhole in the sense that it opens out onto the outer surface 21 of the base hob 2, as well as onto its inner surface 22, but said hole is not a full hole in the sense that its periphery, as much for the outer surface as for the inner surface, is not closed.

In this case, the joint 6 is only present along three edges of the periphery of the window 5, or in any case along the periphery of the window 5 which is opposite the base hob 2.

It is possible to provide that the window 5 extends beyond the edge (in this case the right-hand edge) of the base hob 2 in which the notch which forms the hole is placed.

For said variant of FIG. 7, it is possible to use one of the solutions for the joint 6 shown in FIGS. 2 to 6.

Whatever the shape of the hole (FIG. 1 or FIG. 7) in which the window 5 is positioned, said hole is preferably formed by cutting the base hob 2 before the stage of ceramicization in the case of a ceramic base hob.

It is possible to provide that the window 5 is compatible with a touch screen 7 by providing a conductive transparent film against the inner surface 52.

The solutions shown above for fixing the control and/or display screen 7 under said window 5 have the important advantage of being able to change the screen 7, if necessary, without having to change the window 5 and above all, without having to change the joint 6, whilst always guaranteeing that the new screen 7 is positioned and fixed correctly in relation to the window 5.

Furthermore, although this has not been mentioned it is possible that the base hob is not flat; in this case, at least in part along the periphery of the hole in the base hob, the outer surface of the window has a retaining wall, toward the inside or the outside.

In order to realize the joint 6 as claimed in the invention, several solutions can be implemented as alternatives:

In a first solution, so-called "encapsulation", shown by way of FIGS. 8 to 11, the base hob 2, the window 5 as well as means for fixing the control and/or display screen are all arranged in a mold part 90, then another mold part 91 is closed on the former; a mold cavity 92 is arranged between said two mold parts, said cavity having the desired shape of the joint 6 in the hollow (in this case the shape of the joint in FIG. 3).

The mold cavity 92 includes the recesses 93 for the positioning of the screws 82 before molding so that the base 80 of each screw is positioned in the mold cavity but the threaded part of each screw is protected so that the material of the joint does not come into contact with the pitch of the screw during the molding of the joint.

A synthetic material is then injected into the mold cavity so as to form the joint 6 including means for fixing the control and/or display screen 7.

Said solution is particularly practical to implement when the joint includes an insert as it allows the correct positioning of the insert to be ensured in relation to the elements introduced into the mold: the base hob 2 and the window 5.

FIGS. 9 to 11 show a manner of positioning the base hob 2 correctly in relation to the mold part 90 and the window 5 in relation to said mold part 90.

The mold part 90 thus includes retractable centering elements 95 for centering the base hob 2 in relation to the mold part 90, as well as fixed centering elements 96 for centering the window 5 in relation to the mold part 90.

Once the base hob 2 has been centered in relation to the mold part 90 thanks to the retractable centering elements 95, as shown in FIG. 10, said elements are retracted into the mold part 90, then the window 5 is introduced into the mold part and is centered by means of the fixed centering elements 96, as shown in FIG. 11.

It must be noted that for the encapsulation solution, it is not necessary for the mold to accommodate the entire base hob 2; it can be provided that the molding is only effected over one part of the base hob 2, the part which includes the hole in which the window 5 is fixed thanks to the joint 6.

In a second solution, so-called "bonding", the joint 6 is preformed (manufactured beforehand into the desired shape) and it thus already includes the means for fixing the control and/or display screen 7; then said joint 6 is bonded to the base hob 2 and/or to the window 5.

In a third solution, so-called "by withdrawal", the joint 6 including means for rigidly fixing the control and/or display screen 7 is molded against the base hob 2 or against the window 5; subsequently, the window 5 or respectively the hob 2 is then introduced into a groove of the frame formed by the joint 6 when this latter is hot and the window 5 is then fixed to the base hob 2 by withdrawing the material constituting the joint 6, with no chemical adhesion between the joint and the window or respectively the base hob.

If the joint is molded against the base hob 2, the groove of the frame which accommodates the window 5 is formed by the joint central part 60, the joint outer part 61 extending over the window 5 and the joint inner part 62 extending under the window 5.

If the joint is molded against the window 5, the groove of the frame which accommodates the base hob 2 is formed by the joint central part 60, the joint outer part 61 extending over the base hob 2 and the joint inner part 62 extending under the base hob 2.

The present invention is described in what precedes by way of example. It is understood that the expert is in a position to realize different variants of the invention without necessarily departing from the framework of the patent such as defined by the claims.

The invention claimed is:

1. A cooking hob for a fixed or mobile cooking appliance comprising:

a base hob, or a ceramic base hob, including at least one cooking area and including at least one control and/or information area, the control and/or information area being formed by a window separated from the base hob by at least one joint made of synthetic material, wherein the joint includes an accessory that extends under an inner surface of the base hob and/or under an inner surface of the window to fix a control and/or display screen under the window, the accessory including a rail including a first leg, a second leg parallel to the first leg, and a third leg connecting the first leg to the second leg such that the rail is formed in the shape of an H, the first leg of the rail being encapsulated entirely within the material of the joint and the second leg protrudes outside of the joint and directly contacts the control and/or display screen.

2. The cooking hob as claimed in claim 1, wherein an inner part of the joint, in vertical section, is in a form of a C or an L under the inner surface of the window.

3. The cooking hob as claimed in claim 1, wherein at least part, or all, of an outer surface of the window is not in a plane of an outer surface of the base hob.

4. The cooking hob as claimed in claim 1, wherein the joint includes a joint outer part extending above a joint central part and/or extending over an outer surface of the base hob and/or over an outer surface of the window.

5. A fixed or mobile cooking appliance comprising a cooking hob as claimed in claim 1.

6. A process for manufacturing a cooking hob as claimed in claim 1, comprising:

arranging the base hob and the window in a mold which is then closed; and injecting a synthetic material into a mold cavity to form the joint including the accessory that extends under the inner surface of the base hob and/or under the inner surface of the window to fix the control and/or display screen under the window, the accessory including the rail including the first leg, the second leg parallel to the first lea, and the third leg connecting the first lea to the second leg such that the rail is formed in the shape of an H, the first leg of the rail being encapsulated entirely within the material of the joint and the second leg protrudes outside of the joint and directly contacts the control and/or display screen.

7. A process for manufacturing a cooking hob as claimed in claim 1, comprising:

preforming the joint that includes the accessory that extends under the inner surface of the base hob and/or under the inner surface of the window to fix the control and/or display screen under the window, the accessory including the rail including the first leg, the second leg parallel to the first leg, and the third leg connecting the first leg to the second leg such that the rail is formed in the shape of an H, the first leg of the rail being encapsulated entirely within the material of the joint and the second leg protrudes outside of the joint and directly contacts the control and/or display screen; and bonding the joint to the base hob and/or to the window.

8. A process for manufacturing a cooking hob as claimed in claim 1, comprising:

molding the joint that includes the accessory that extends under the inner surface of the base hob and/or under the inner surface of the window to fix the control and/or display screen under the window against the base hob or against the window, the accessory including the rail including the first leg, the second lea parallel to the first lea, and the third leg connecting the first leg to the second lea such that the rail is formed in the shape of an H, the first leg of the rail being encapsulated entirely within the material of the joint and the second leg protrudes outside of the joint and directly contacts the control and/or display screen, the window or respectively the base hob then being introduced into a groove of a frame formed by the joint when the joint is hot.

9. The cooking hob as claimed in claim 1, wherein the joint directly contacts a top surface of the control and/or display screen and the accessory directly contacts a bottom surface of the control and/or display screen.

* * * * *